United States Patent [19]

Jardine

[11] 4,377,074

[45] Mar. 22, 1983

[54] ECONOMIZER REFRIGERATION CYCLE SPACE HEATING AND COOLING SYSTEM AND PROCESS

[75] Inventor: Douglas M. Jardine, Colorado Springs, Colo.

[73] Assignee: Kaman Sciences Corporation, Colorado Springs, Colo.

[21] Appl. No.: 278,849

[22] Filed: Jun. 29, 1981

[51] Int. Cl.[3] ..... F25B 39/04

[52] U.S. Cl. ..... 62/183; 62/160; 62/238.6

[58] Field of Search ..... 62/160, 183, 238.2, 62/238.6; 237/2 B

[56] References Cited

U.S. PATENT DOCUMENTS

| | | | |
|---|---|---|---|
| 3,080,706 | 3/1963 | Flynn, Jr. et al. . | |
| 3,807,190 | 4/1974 | Grant | 62/183 X |
| 3,858,802 | 1/1975 | Stobart | 62/6 |
| 4,055,960 | 11/1977 | St. Clair | 62/6 |
| 4,111,259 | 9/1978 | Lebduska | 62/160 X |
| 4,148,195 | 4/1979 | Gerstmann et al. | 62/6 |
| 4,238,931 | 12/1980 | Campbell | 62/183 |
| 4,251,996 | 2/1981 | Esformes et al. | 62/183 X |
| 4,312,188 | 1/1982 | Swenson et al. | 62/160 |
| 4,325,226 | 4/1982 | Schaeffer | 62/238.6 |

*Primary Examiner*—Lloyd L. King

*Attorney, Agent, or Firm*—Max L. Wymore

[57] ABSTRACT

This invention relates to heating and cooling systems and more particularly to an improved system utilizing a Stirling Cycle engine heat pump in a refrigeration cycle.

4 Claims, 18 Drawing Figures

| OPERATING MODE | REVERSING VALVE FLOW | HEAT EXCHANGER SERVICE | |
|---|---|---|---|
| | | HEAT SOURCE / SINK EX. | LOADSIDE EXCHANGER |
| LOAD COOLING | C TO A; D TO B | CONDENSER | EVAPORATOR |
| LOAD HEATING | C TO D; A TO B | EVAPORATOR | CONDENSER |

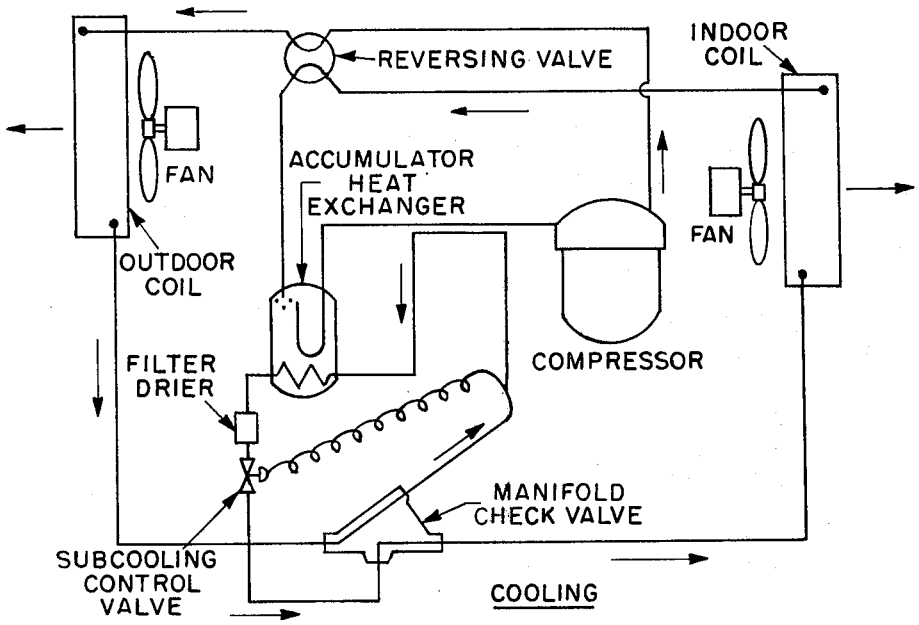
FIG. 4A *(PRIOR ART)*
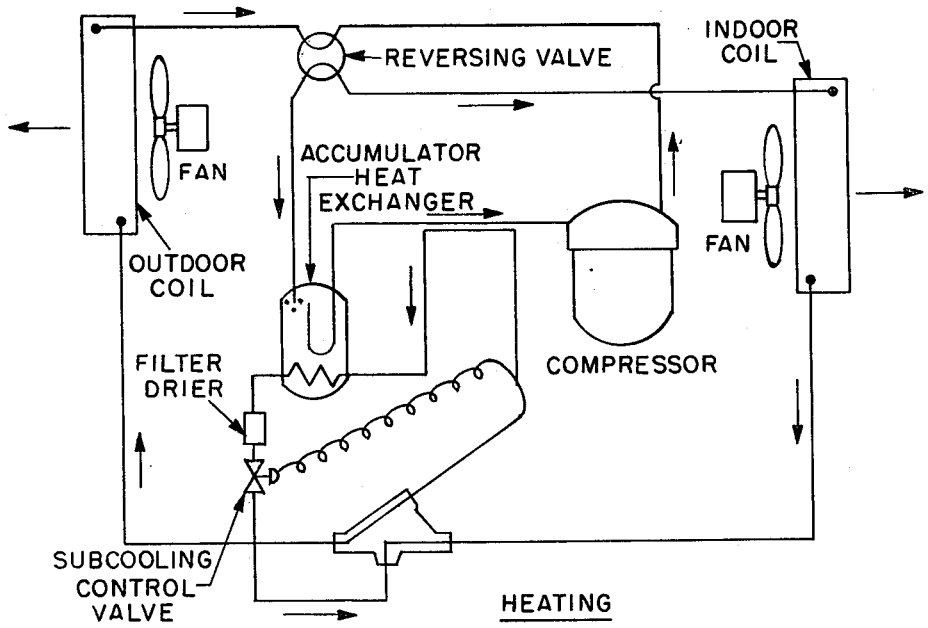
FIG. 4B *(PRIOR ART)*

PRIOR ART

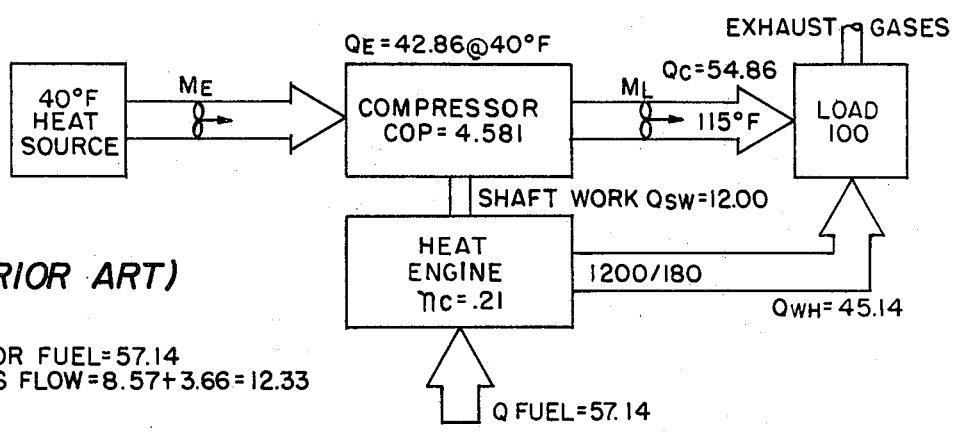

FIG. 15 *(PRIOR ART)*

COMPRESSOR FUEL=57.14
TOTAL MASS FLOW=8.57+3.66=12.33

WASTE HEAT FROM ENGINE INTRODUCED DIRECTLY TO LOAD. COMPRESSOR COP SET BY HEAT SOURCE TEMPERATURE.

MASS FLOW $M_E = \frac{42.86}{40-35} = 8.57$. $M_L = \frac{54.86}{115-100} = 3.66$

PRESENT INVENTION

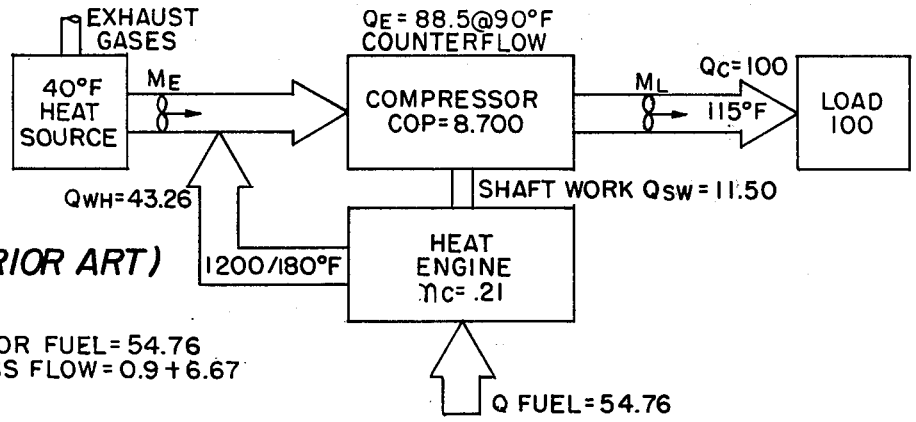

FIG. 16 *(PRIOR ART)*

COMPRESSOR FUEL=54.76
TOTAL MASS FLOW=0.9+6.67

WASTE HEAT FROM HEAT ENGINE INTRODUCED TO FLUID TO REFRIGERANT COUNTERFLOW EVAPORATOR. COMPRESSOR COP SET BY REDUCED FLOW WASTE HEAT TEMPERATURE

MASS FLOW $= \frac{88.5-43.26}{90-40} = 0.90$. $M_L = \frac{100}{115-100} = 6.67$

FIG. 17

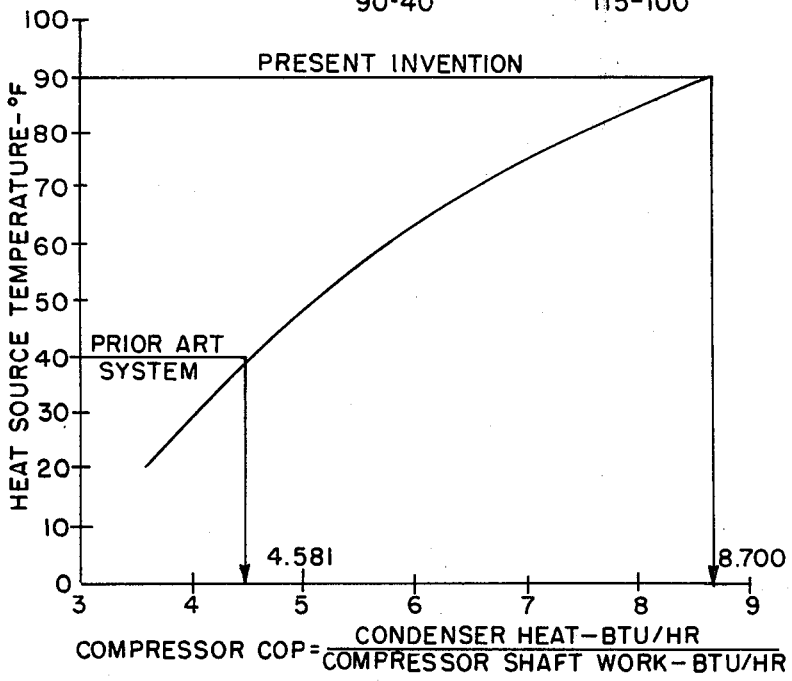

ECONOMIZER REFRIGERATION CYCLE SPACE HEATING AND COOLING SYSTEM AND PROCESS

The Government has rights in this invention pursuant to Contract No. DE-AC-03-79-CS 30207 awarded by the U.S. Department of Energy.

BACKGROUND OF THE INVENTION

The basic refrigeration cycle can be used to cool a load by having the evaporator temperature lower than the load temperature so that heat flows to the evaporator from the load. This cycle removes heat from the load which is transferred to a refrigerant flowing through the evaporator. The refrigerant leaves the evaporator as a super heated gas and flows with the compressor where additional super heat is added increasing the temperature as well as the pressure, see FIG. 1. The evaporator heat and the heat of compression are rejected from the condenser at a temperature that is higher than the evaporator temperature.

The cycle heat balance formula is:

$$Q_C = Q_E + Q_W \quad (1)$$

where:

$Q_C$=condenser heat rejection $Q_E$=evaporator heat gain $Q_W$=heat equivalent of compressor work The restated cycle formula in heat balance form, where $1/V_R$=mass flow rate is:

$$(1/V_R)(h_2-h_4)=(1/V_R)(h_1-h_4-5)+(1/V_R)(h_2-h_1) \quad (2)$$

Referring to FIG. 2 which shows the Pressure Enthalpy Diagram for a refrigerant cycle, the evaporator heat is equal to $h_1-h_5$, the compression heat is equal to $h_2-h_1$ and the condenser heat is equal to $h_2-h_4$; $h_4 \simeq h_5$. The amount of work done by the compressor to produce a given refrigerant effect at the evaporator depends upon the pressure (temperature) difference between the condenser and the evaporator. The coefficient of performance (COP) for the refrigerant cycle is $COP_H$ for heating and $COP_C$ for cooling and these are defined as follows:

$$COP_H=(h_2-h_1)/(h_2-h_1) \quad (3)$$

$$COP_C=(h_1-h_5)/(h_2-h_1) \quad (4)$$

The refrigeration cycle is called a heat pump when a refrigeration cycle has a refrigerant reversing valve added so the evaporator and condenser functions are interchangeable, i.e., a load can be heated and cooled by the cycle. FIG. 3 shows a heat pump system.

Refrigeration and heat pump systems which are state of the art are as follows:

TABLE I

| Compressor Drive | Heat Source/Sink Exchanger | Load Side Exchanger |
|---|---|---|
| Electric Motor | Refrigerant to Air | Refrigerant to Air |
| Electric Motor | Refrigerant to Fluid | Refrigerant to Air |
| Electric Motor | Refrigerant to Air | Refrigerant to Fluid |
| Electric Motor | Refrigerant to Fluid | Refrigerant to Fluid |
| Stirling Engine | Refrigerant to Air | Refrigerant to Air |

A Stirling engine heat pump with other than a refrigerant to air heat exchangers is neither state of the art nor novel.

FIG. 4 shows a typical air to air heat pump system and FIG. 5 shows the state of the art operating characteristics for a heat pump operating in the heating mode against various heat source and heat sink temperatures.

A Stirling engine heat pump in simplistic terms is a free piston in a closed cylinder such that one end of the piston receives work from combustion while the other end of the piston imparts work to a refrigerant. FIG. 6 shows a Stirling engine heat pump operating in a heating cycle and FIG. 7 shows this system operating in a cooling cycle. Present Stirling engineer systems do not operate at efficiencies that they are capable and are therefore wasteful of energy.

SUMMARY OF THE INVENTION

The present invention resides in a thermal energy utilizing system including a Stirling engine wherein an increased efficiency of operation is obtained by optimizing the operating parameters and the apparatus for accomplishing this new and novel desired end result.

With a Stirling cycle engine heat pump as normally used, the jacket heat is rejected directly to the heating load with the heat pump in the heating mode such that the jacket heat is wasted to the atmosphere along with the condenser heat with the heat pump operating in the cooling mode. The present invention resides in the moving thermal energy between the heat source/sink and the heat source/sink heat exchanger in the most energy efficiency manner possible; balancing the heat flow from the heat sink to the heat source/sink heat exchanger; and employing one or more heat pumps simultaneously with combined or single heat sources and sinks in the most energy efficient fashion.

These and other advantages of the present invention will be apparent from the following detailed description taken in connection with the drawings.

BRIEF DESCRIPTION OF THE DRAWINGS

FIG. 4A shows a typical air source heat pump schematic for cooling and

FIG. 4B shows heating;

FIG. 15 is a diagram representative of the prior art introduction of waste heat directly to a load;

FIG. 16 is a diagram according to the present invention for the introduction of waste heat of an engine to refrigerant evaporator; and FIG. 17 is a graphical representation of a typical compressor performance of a prior art system versus a system according to the present invention.

DETAILED DESCRIPTION OF THE INVENTION

Figure 9:
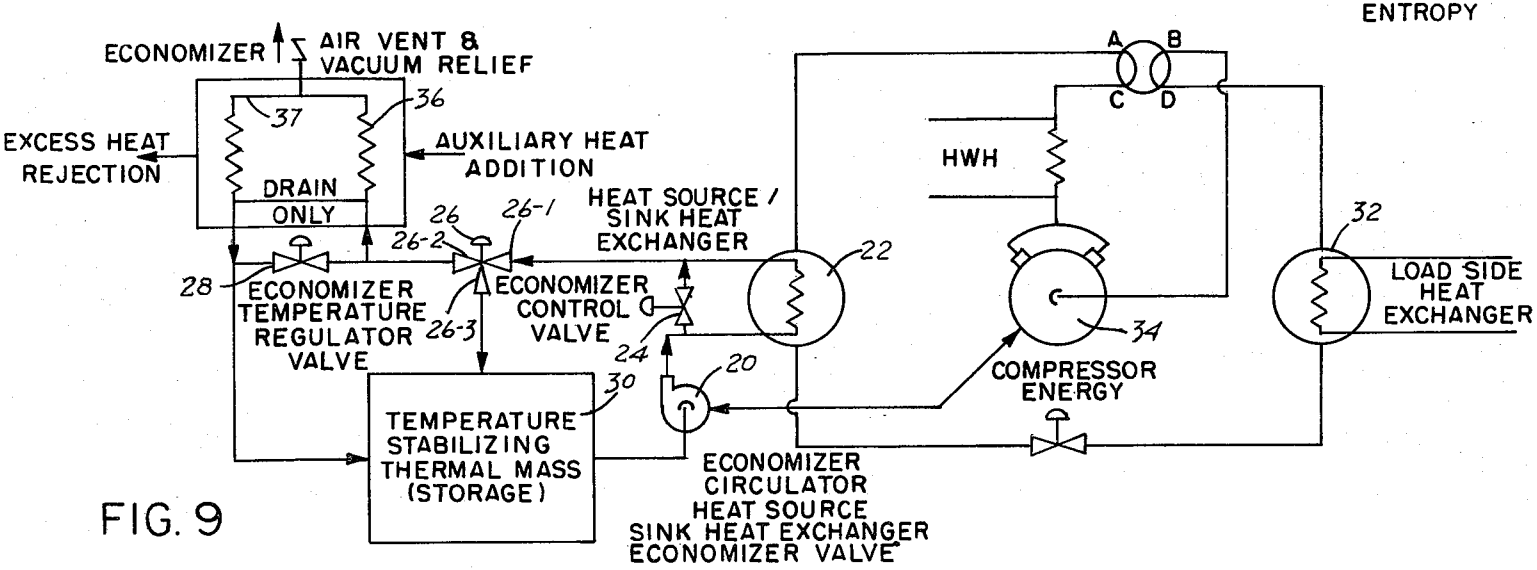
FIG. 9 is a block diagram of the basic economizer system according to the present invention.

Referring to the drawings and in particular to FIG. 9, the present invention resides on the heat source/sink side of a refrigeration cycle or on the heat sink side of a heat pump, and consists of an economizer circulator 20, the heat source/sink heat exchanger 22, a heat source/-sink exchanger economizer valve 24, the economizer control valve 26, the economizer temperature regulator valve 28, and a temperature stabilizing thermal mass or temperature regulated thermal storage 30.

When the refrigeration cycle operates to cool the load, heat from the load 32 plus the heat equivalent of the compressor energy of compressor 34 is rejected from the cycle through the heat source/sink heat exchanger 22 to the coolant moved from storage by the economizer circulator 20. When the heat level in the economizer system is at the desired level and the condensing temperature is at the desired level to produce energy efficient refrigeration cycle operation, the coolant flows in port 26-1 and out port 26-3 of valve 26 with port 26-2 being closed. The coolant flows back to storage 30 where the coolant temperature adjusts to meet the dynamic temperature caused by interacting with the thermal mass of the storage. The coolant could be a gas such as air, or a fluid such as water and the thermal mass of storage 30 could be rocks or encapsulated eutectic material employing the heat of fusion providing thermal for gas or a tank of water, a ground coupled tank, serpentine coil, sealed vertical well, or a ground water acquifier type reservoir all would be a suitable storage. When the level of thermal energy is low in storage 30, and the coolant temperature is lower than desired for reliable refrigeration cycle operation, the heat source/-sink heat exchanger economizer valve 24 opens and modulates to provide full flow by the economizer circulator 20, but only the amount of flow required to maintain the refrigeration condensing temperature desired in the heat source/sink heat exchanger 22. This arrangement keeps the refrigerant cycle and economizer circulator 20 operating with maximum cost effectiveness and energy efficiency when the storage 30 temperature is lower than desired and auxillary heat is either unavailable or available at some real or fossil fuel energy cost. As the storage 30 temperature rises, the heat source/-sink heat exchanger economizer valve closes such that the desired refrigerant condensing temperature is maintained in the refrigeration cycle until the energy level in storage 30 becomes excessive, and a higher than desired coolant temperature exists.

When the amount of thermal energy in storage 30 is at a maximum and the coolant temperature is the minimum desired, the economizer control valve port 1, 26-1, opens to port 26-2 and closes port 26-3, causing the coolant to fill the economizer 36 with coolant and circulate coolant from storage 30 through heat source/sink heat exchanger 22 and the economizer 36 back to storage 30. Heat is rejected from the economizer 36 to the atmosphere or some intentional use at a desired temperature by radiation, conduction or evaporative cooling. When the coolant is being circulated through the economizer 36, the economizer temperature regulator valve 28 acts to bypass coolant around the economizer 36 in an amount necessary to maintain the desired refrigerant condensing temperature in the heat source/sink heat exchanger 22 by balancing the heat rejected from the refrigeration cycle with the storage losses and/or near full storage capacity reduced storage thermal charging rate. Thus, the economizer cycle is employed to maintain a constant refrigerant condensing temperature while maintaining the desired amount of thermal energy in storage at a desired temperature when sufficient heat is available, and by modulating from a constant mass flow rate coolant stream the proper amount of below normal temperature coolant. With the proper amount of thermal storage capacity in the economizer system, it is possible to employ night time dark sky radiation and atmospheric convective conduction for refrigeration cycle heat rejection to support day time or around the clock refrigerant cycle operation with a constant refrigerant condensing temperature in the cycle which is lower than normally achievable condensing temperatures available from cooling towers or evaporative coolers which are totally dependent on minute by minute atmospheric dry and wet bulb temperatures. The temperature range and upper temperature limit of the thermal storage act with thermal capacitance coupled with night time black sky and ambient air heat sink to hold the refrigerant cycle condensing temperature below that achievable during daylight hours. By moving the refrigeration cycles condensing temperature to a lower temperature closer to evaporator temperature thereby increasing the cooling capacity of a given refrigeration cycle and decreasing the amount of compressor energy required to operate the refrigeration cycle.

The economizer cycle is configured so that when the coolant fluid employed is water, the economizer 36 is positioned at a level above the storage area 30 and the storage thereof has available space and is vented to the atmosphere. Further the economizer has a means of taking air into and releasing air from the uppermost fluid passage 37 such that the economizer will fill with water when the economizer control valve 26 is open port 26-1 to 26-2 with 26-3 closed, and operate full of water. The economizer 36 will drain and remain drained when the economizer control valve 26 has port 26-1 open to port 26-3 with port 26-2 closed. In the preferred configuration, the economizer 36 is disposed above the economizer control valve 26 and the economizer temperature regulator valve 28 and both of these valves being positioned above the storage 30.

When the refrigeration cycle acts to heat the load through the load side heat exchanger 32 the heat removed from storage plus the heat equivalent of the compressor 34 energy is provided to the load from this heat exchanger. The heat from storage 20 in the coolant is moved to the heat source/sink heat exchanger 22 by the economizer circulator 36. When the heat level in the economizer 36 system is at the desired level and the evaporator temperature is at the desired level to cause energy efficient heat pump cycle operation, the coolant flows in port 26-1 and out of port 26-3 of the economizer control valve 26, with port 26-2 closed, back to storage where the coolant temperature adjusts to meet the dynamic temperature caused by interacting with the thermal mass of the storage 30. The coolant could be a gas such as air, or a fluid such as water; with the thermal mass of the storage 30 being binned rocks or encapsulated eutectic material employing the heat of fusion for gaseous coolants; or a tank of water, a ground coupled water tank, serpentine coil, sealed vertical well, or a ground water acquifier type reservoir. When the level of thermal energy is high in storage 30 and the coolant temperature from storage 30 is higher than desired for reliable heat pump cycle operation, the heat source/sink heat exchanger valve 24 opens and modulates to provide full flow by the economizer circulator 20 but only the amount of flow to maintain the refrigerant evaporating temperature desired in the heat source/sink heat exchanger 22. This arrangement keeps the refrigerant cycle and economizer circulator 20 operating with cost effectiveness and energy efficiency when the storage 30 temperature is higher than desired. As the storage 30 temperature drops the heat source/sink heat exchanger economizer valve 24 closes such that the desired refrigerant evaporating temperature is maintained in the refrigeration cycle until the energy level in the storage 30 becomes undesirably low, and a lower than desired coolant temperature exists.

When the amount of thermal energy in storage 30 is less than maximum, and auxiliary heat is available from intended sources such as a low temperature (cost) solar collectors, low temperature geo thermal, the sensible or latent heat of the atmosphere, low temperature (below condenser temperature but above evaporator temperature) waste heat; jacket and combustion waste gas from a Stirling engine heat pump, or process heat from a fuel cell. The economizer control valve 26 opens port 26-1 to port 26-2 and closes port 26-3, causing the coolant circulator 20 to fill, if necessary, and circulate coolant through the economizer 36 from storage 30 to the heat source/sink heat exchanger 22 and through the economizer 36, where heat is added to the coolant, and back to storage. Heat is added to the coolant in the economizer 36 from one or some combination of the above auxiliary energy sources when the source or sources are available. Thus, the storage 30 must have ample thermal capacity to properly supply heat to the needs of the heat between the times of auxiliary energy availability. When the coolant is being circulated through the economizer 36, the economizer temperature regulator valve 28 acts to bypass coolant around the economizer in the amount necessary to maintain the desired refrigerant evaporating temperature in the heat source/sink heat exchanger 22 by balancing the heat taken in through the evaporator of the refrigerant cycle in the heat source/-sink heat exchanger 22, the amount of heat lost from storage 20, and the amount of heat taken into storage 30 at the near storage capacity reduced storage charging rate with the amount of heat taken into the coolant in the economizer 36. The economizer cycle of the present invention is employed to maintain a constant refrigerant evaporating temperature while maintaining the selected amount of heat in storage a predetermined temperature when sufficient heat is available and by modulating from a constant mass flow rate coolant stream, the proper amount of above normal temperature coolant. Further, with the proper amount of thermal storage capacity in the economizer system of the present invention, it is possible to employ intermittent energy sources such as solar energy as well as constant sources such as waste heat or low temperature geo thermal heat for the economizer heat source to support night time or auxiliary energy insufficiency or times heat pump cycle load heating operation with a constant refrigerant evaporating temperatures available from the atmosphere, ground water, ground, or winter time surface waters, or the like heat sources. The temperature range and lower temperature limit of the thermal storage act with thermal capacitance coupled with the intermittently available or constantly available economizer heat source to hold the refrigerant cycle evaporating temperature above that available from ambient heat sources during diurnal and seasonal averages when loads require heat. Thus, moving the evaporator temperature of the refrigeration cycle to a higher level closer to condenser temperature thereby increasing the heat capacity of a given refrigeration cycle operating as a heat pump and decreasing the amount of compressor energy required to operate the refrigeration cycle as a heat pump.

The economizer cycle of the present invention, FIG. 9, is configured so that when the coolant fluid employed is water and the economizer 36 is disposed above the storage area, the storage containing 30 has available space and is vented to the atmosphere and the economizer has a vent means 24 for taking air into and releasing air from the uppermost fluid passage 37 in economizer such that the economizer will fill with water when the economizer control valve 26 is open connecting port 26-1 to port 26-2, and port 26-3 is closed so the economizer operates full of water; and the economizer will drain and remain drained when the economizer control valve 26 is disposed with port 26-1 open to port 26-3 with port 26-2 closed. In the preferred configuration, the economizer is disposed above the economizer control valve 26 and the economizer regulator valve 28, and both of these valves are disposed above the storage container 30.

Employing the economizer drainback feature is an important feature of the present invention. Employing water in the economizer 36 and heat source/sink heat exchanger requires less heat exchanger surface and thus is less expensive, less heat exchanger pumping power, and provides higher heat exchanger efficiency than would be required or provided by other available working fluids, thus providing both cost and fossil fuel based energy savings. The drainback provision is required to prevent water boiling or freezing in the economizer 36 during the time the economizer is not in operation and when ambient conditions are adverse enough to cause either freezing or boiling of the water therein.

Two additional areas of interest are the application of a Stirling engine to drive the heat pump in the economizer refrigeration cycle space heating/cooling and process heating system and the use of a fuel cell power plant coupled with an electric driven economizer refrigeration cycle heating and cooling. In both cases usable waste heat is generated.

Figure 1:
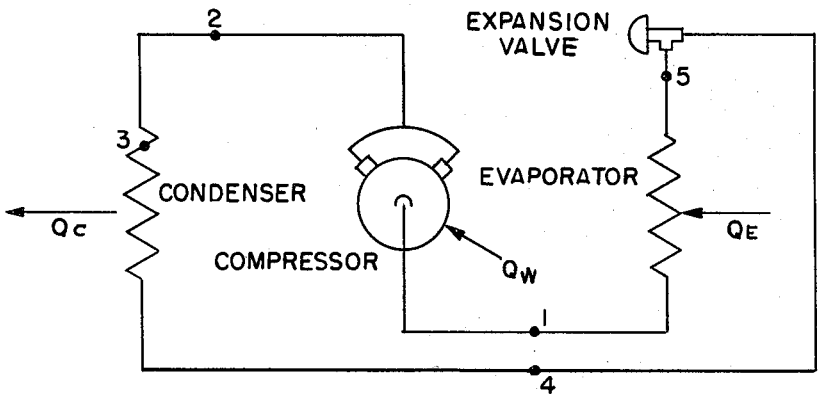
FIG. 1 (PRIOR ART)
FIG. 1 shows a basic prior art refrigeration system cycle.
Figure 2:
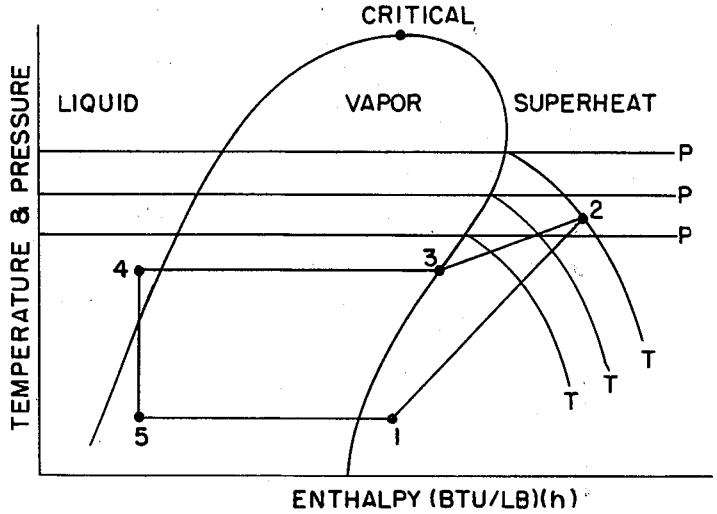
FIG. 2 (PRIOR ART)
FIG. 2 is a pressure enthalpy diagram for refrigerant cycle.
Figure 3:
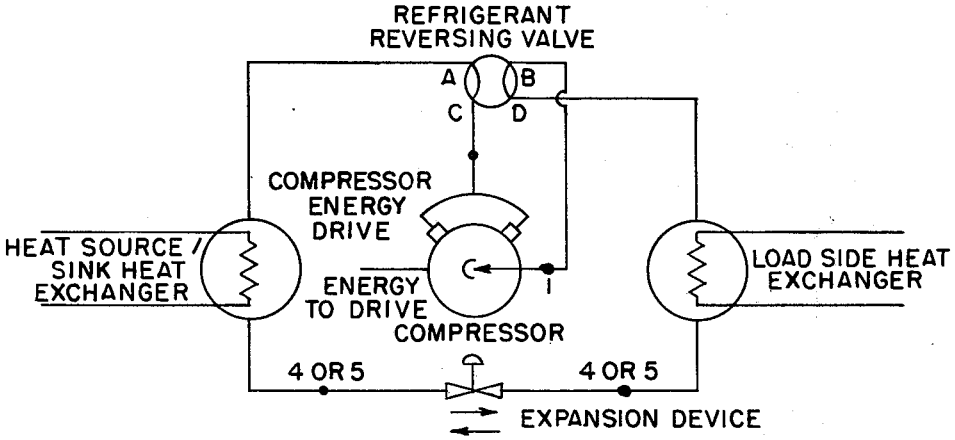
FIG. 3 (PRIOR ART)
FIG. 3 shows a generic heat pump system.
Figure 5:
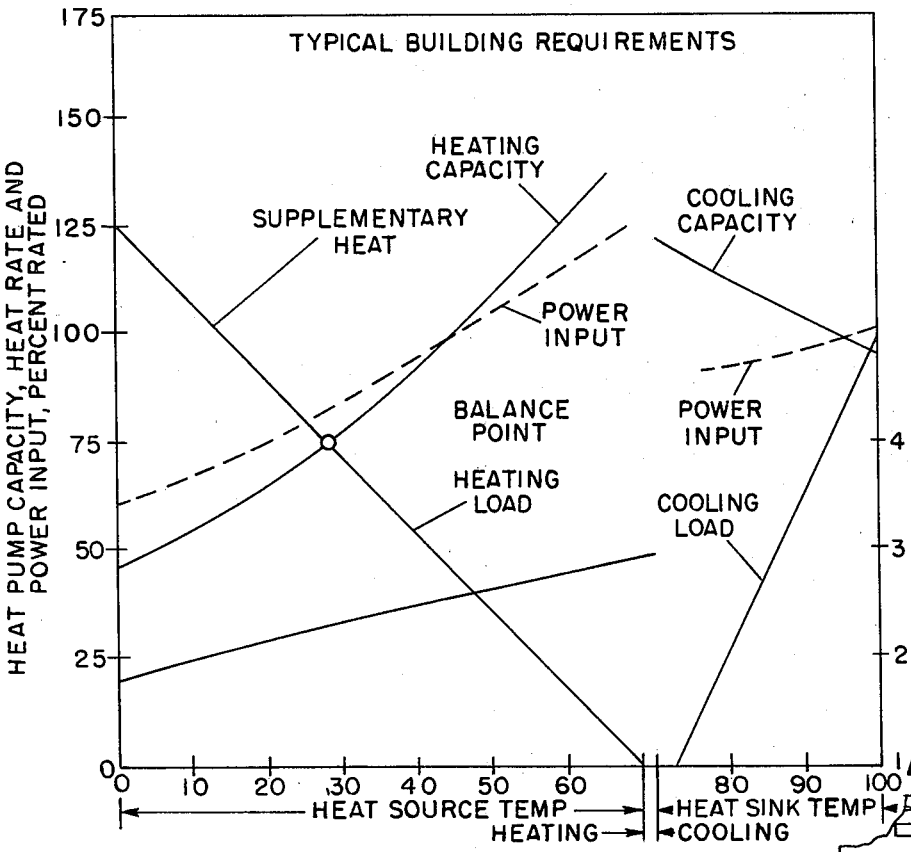
FIG. 5 (PRIOR ART)
FIG. 5 is a graphical representation of a heat pump operating characteristics.
Figure 6:
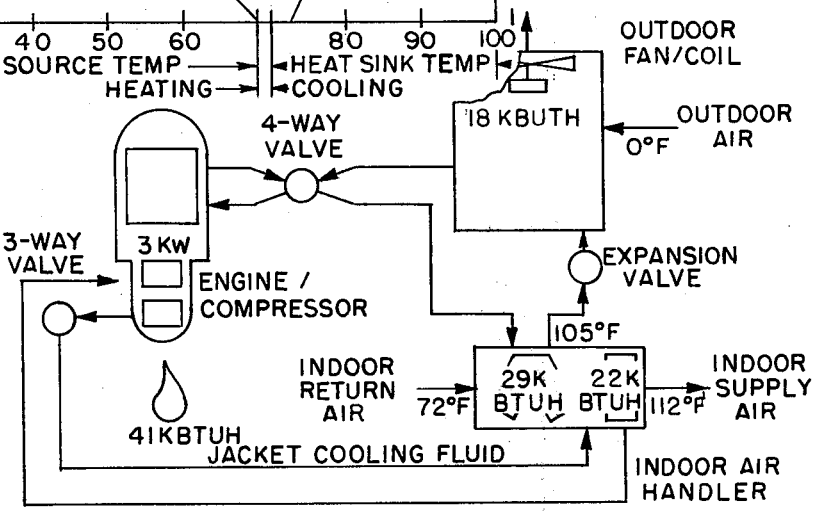
FIG. 6 (PRIOR ART)
FIG. 6 represents a Stirling engine heat pump operating in load heating mode.
Figure 7:
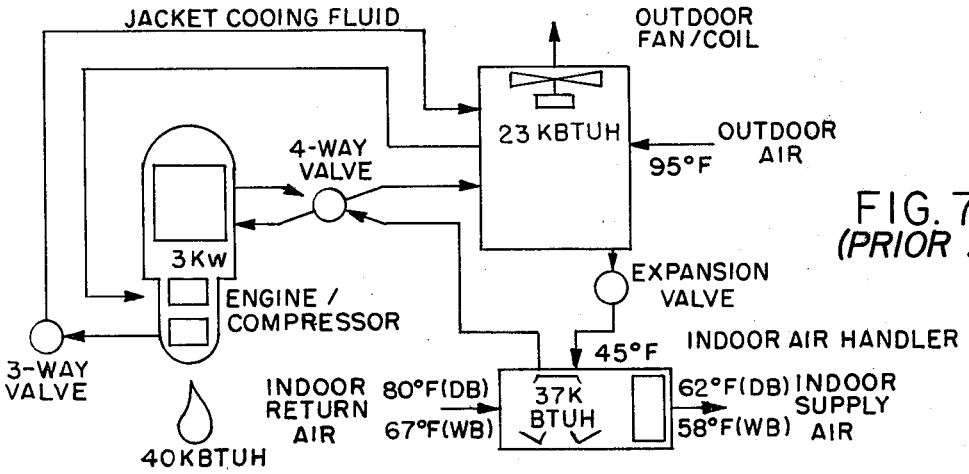
FIG. 7 (PRIOR ART)
FIG. 7 represents a Stirling engine heat pump operating in load cooling mode.
Figure 8:
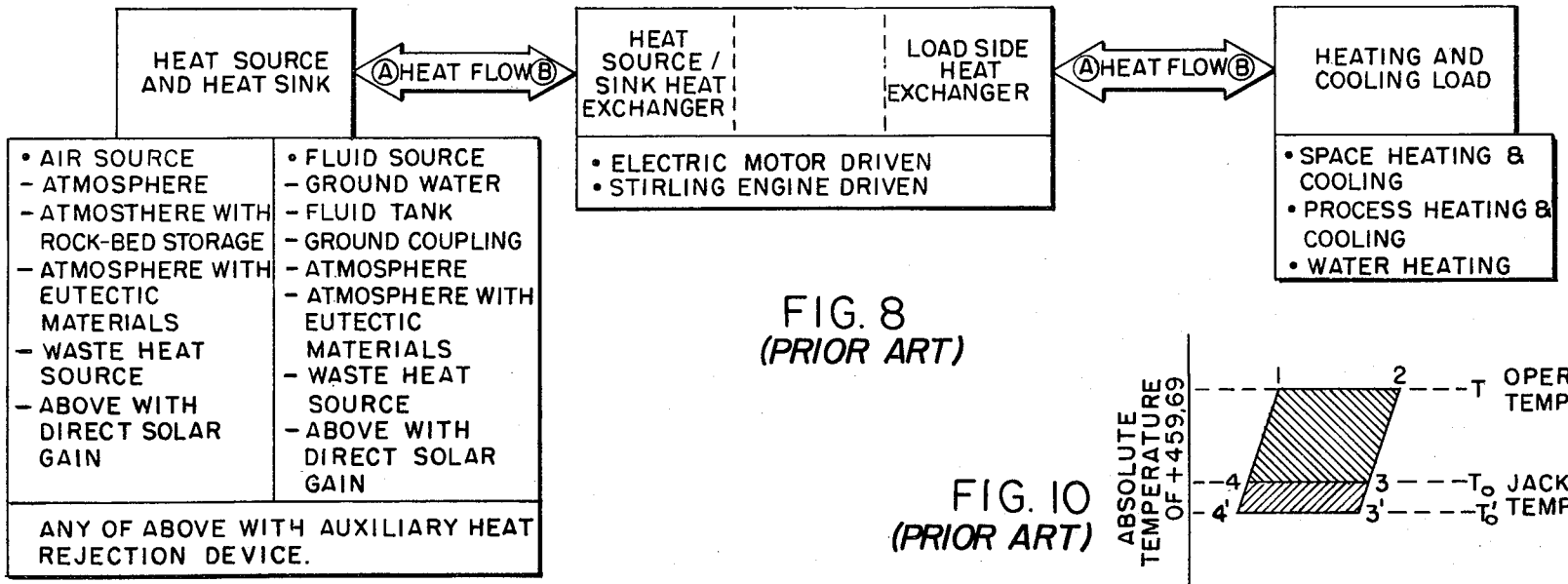
FIG. 8 (PRIOR ART)
FIG. 8 is a heat pump system block diagram with state of the art applications.

Referring to FIGS. 6 and 7, it will be seen that with present Stirling engine systems the jacket heat is used to contribute waste heat to the space heating load by adding the jacket heat to the load heating airstream after the condensor heat of the refrigerant cycle is added to this airstream, thus, setting the jacket temperature of the Stirling engine above the heat pump condensing temperature and marginally above the indoor air supply temperature. It is also seen that recoverable heat is lost from the combustion of gas by the following heat balance.

| | | |
|---|---|---|
| (5) | Condenser heat out | = 29 KBTU/HR |

-continued

| | | | |
|---|---|---|---|
| | less | Evaporator heat in | = 18 KBTU/HR |
| | equals | Compressor work | = 11 KBTU/HR (heat equiv) |
| (6) | | Energy into compressor | = 41 KBTU/HR |
| | less | Compressor work | = 11 KBTU/HR (heat equiv) |
| | less | Jacket heat | = 22 KBTU/HR |
| | equals | Unused available heat | = 8 KBTU/HR (stack loss) |

Figure 10:
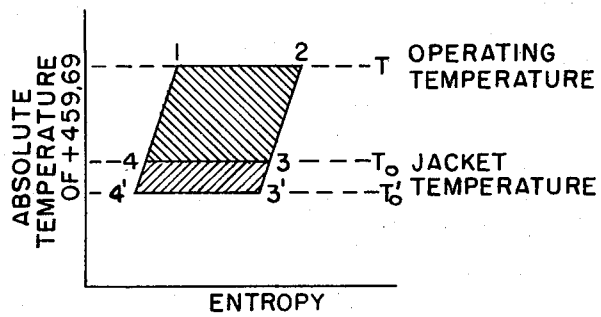
FIG. 10 (PRIOR ART)
FIG. 10 is a graphical representation of a Stirling engine temperature enthalpy diagram.

There are two ways in which the performance of the present Stirling engine combustor engine compressor into the economizer refrigeration cycle space heating-/cooling and process heating system functions, first by increasing the Stirling engine efficiency and second, by narrowing the temperature difference between the heat pump evaporating and condensing temperatures. FIG. 10 shows the temperature/enthalpy diagram for a Stirling engine. The amount of work accomplished by the Stirling engine is directly proportional to T-To, where T is the operating temperature and To is the engine jacket temperature. Thus, for a constant operating temperature of 1200° F. and lowering the jacket temperature from 120° F. to 70° F., an increase in work, or engine efficiency, would be 4.6% calculated by formula 7, as follows:

$$\% \text{ increase in work} = \frac{(T' - To') - (T - To)100}{(T - To)} = \tag{7}$$

$$\frac{100(1659.69 - 579.69) - (1659.69 - 529.64)}{(1659.69 - 529.69)} = 4.6\%$$

Figure 11:
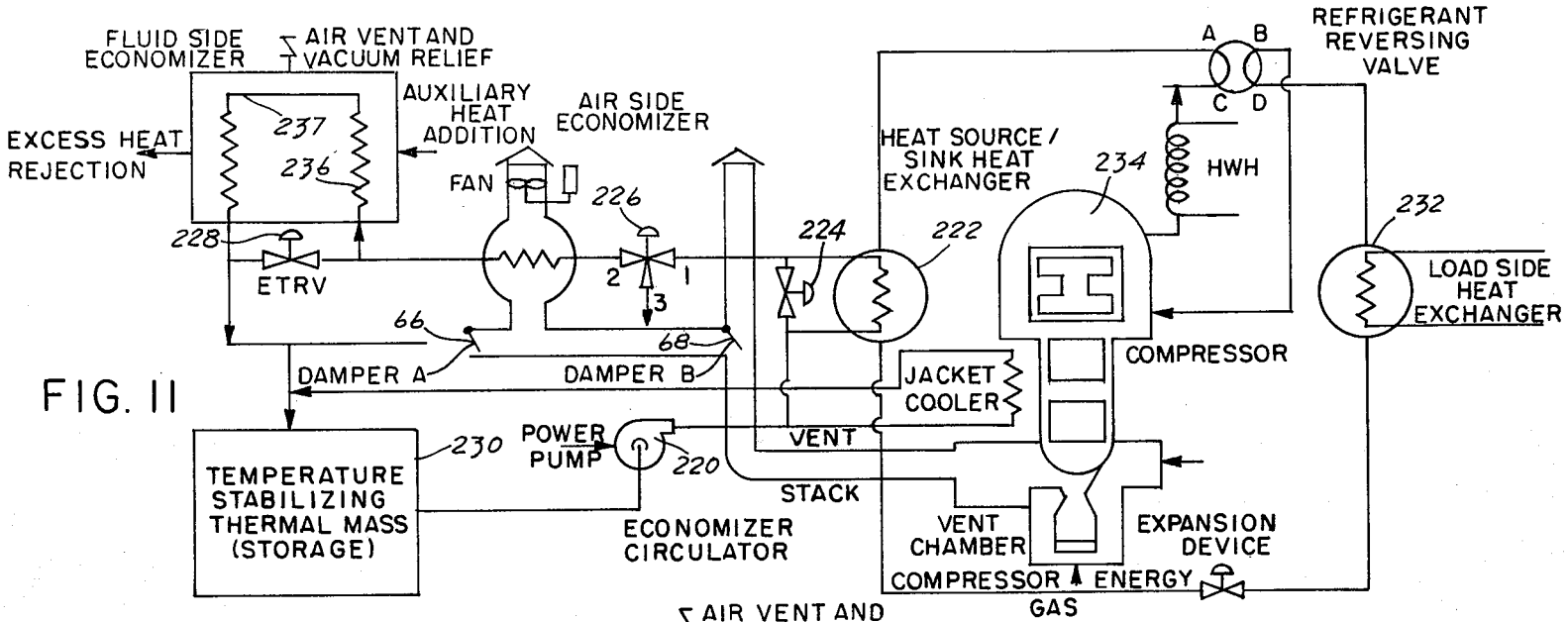
FIG. 11 is a block diagram of a Stirling engine heat pump economizer cycle.
Figure 12:
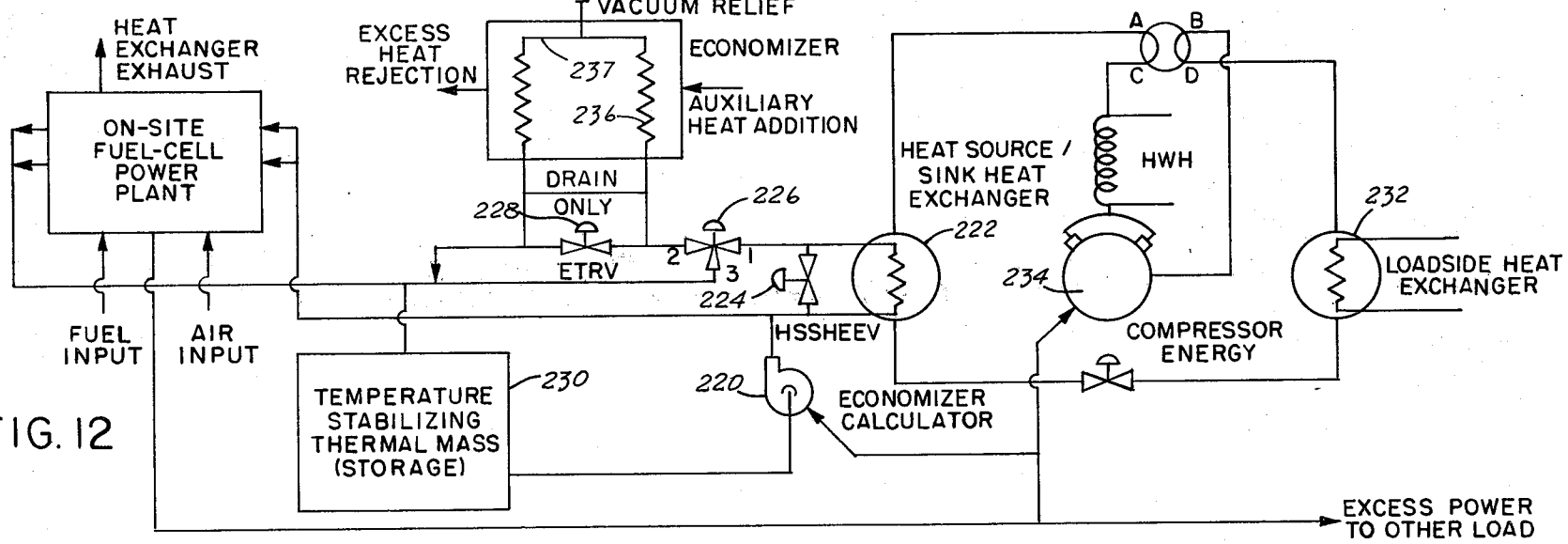
FIG. 12 is a Fuel Cell power plant with the economizer.

This lowering of jacket temperature is accomplished in the economizer refrigeration cycle as shown in FIG. 11 by employing the ground as heat sink for the Stirling engine jacket. Also the heating mode evaporator of the heat pump can be ground coupled. The cooling mode condenser of the heat pump can be ground coupled to achieve an improvement in heating and cooling DOP's as follows using the temperatures shown in FIGS. 6 and 7 and a heat source/sink temperature of 70° F. (529.69° R absolute):

$$\% \text{ increase } COP_H = \frac{\dfrac{T_C}{T_C - T_E} - \dfrac{T_C}{T_C - T_E}}{\dfrac{T_C}{T_C - T_E}} \times 91\ 100 = \tag{8}$$

$$\frac{\dfrac{564.69}{564.69 - 529.69} - \dfrac{564.69}{564.69 - 459.69}}{\dfrac{564.69}{564.69 - 459.69}} \times 100 = 200\%$$

$$\% \text{ increase } COP_C = \frac{\dfrac{T_E}{T_C - T_E} - \dfrac{T_E}{T_C - T_E}}{\dfrac{T_E}{T_C - T_E}} \times 100 = \tag{9}$$

$$\frac{\dfrac{509.69}{519.69 - 509.69} - \dfrac{509.69}{524.69 - 509.69}}{\dfrac{509.69}{524.69 - 509.69}} \times 100 = 150\%$$

In addition to the basic economizer cycle, the Stirling engine driven heat pump includes a jacket cooling flow loop and an air side economizer.

The basic economizer cycle of FIG. 6 is modified to include the Stirling engine with refrigeration compressor, combustor, and vent chamber with vent stack, jacket cooler, i.e., Stirling engine heat sink and the air side economizer with control dampers.

When the Stirling engine operates, coolant is pumped by the economizer circulator 120 and circulated through the Stirling engine jacket cooler back into storage 130. The coolant pumped through this jacket is only a part of the coolant being circulated in the economizer cycle with the amount circulating through the jacket being sufficient to maintain an attainable and efficiently low jacket temperature. One pump is employed in this cycle. The hot combustion gas leaving the combustion chamber is conducted to the atmosphere from the vent chamber of the Stirling engine combustor. This hot combustion gas contains both sensible and latent heat which can be employed in the heat pump heating cycle. When the storage temperature is above a desired level, damper B is closed allowing the hot damper gases to be vented directly to the atmosphere in a safe manner, and damper A is open to the atmosphere with the ID fan running with the economizer control valve 126 open with port 126-1 to port 126-2 and port 126-3 closed, thus allowing the air side economizer to reject all or part of the excess heat from the cycle. When the storage temperature is below a desired limit, damper B opens and damper A closes and the hot combustion gas passes through the air side economizer and transfers the available sensible and latent heat either directly or through a heat exchanger to the coolant, thus adding heat to storage 130. Water is the preferred coolant although a gas such as air could also be used.

The improvement over the normal Stirling engine heat pump is as follows in Table II.

TABLE II

Improvement Over Normal Stirling Engine Heat Pump

| | Heating Cycle | | Cooling Cycle | |
|---|---|---|---|---|
| | Prior Art | Improved | Prior Art | Improved |
| Compressor Input-KBTU/HR | 11.0 | 11.5 | 11.0 | 11.5 |
| Evaporator heat-KBTU/HR | 18 | 47 | 37 | 64 |
| Used waste heat-KBTU/HR | 22 | 30 | 0 | 0 |
| Gas req'd-KBTU/HR | 41 | 41 | 40 | 40 |
| Compressor shaft COP-KBTU/HR | 2.64 | 5.28 | 3.7 | 5.55 |

Over 90% of the noted improvement results from the enhanced heat source/sink operating temperatures resulting from the use of the economizer refrigeration cycle of the present invention in place of using the atmosphere for the heat source/sink. Auxiliary heat addition through the fluid side economizer will be necessary with the heat pump operating in the heating mode as evidenced by the evaporator heat (47 KBTU/HR) exceeding the used waste heat (30 KBTU/HR) by 11 KBTU/HR.

Ideal cycles with perfect gases are discussed in the Mechanical Engineers Handbook, Lional S. Marks, Fifth Edition, page 297, McGraw Hill and is incorporated herein for reference.

It will be appreciated that the Stirling engine is an external combustion engine; however, an internal combustion engine such as a natural gas combustion engine may also be used with equal success in the system of FIG. 11. The dampers A and B thereof would operate the same. The means of exchanging heat from the exhaust gas to water coolant from storage 130 is a closed heat indirect exchanger where hot gases are on one side and water is on the other. The heat exchanger may either be immersed in the storage coolant or mounted at the engine where coolant is pumped through it from storage 130 by the economizer circulator 20 with condensate drained to a suitable drain.

Figure 14:
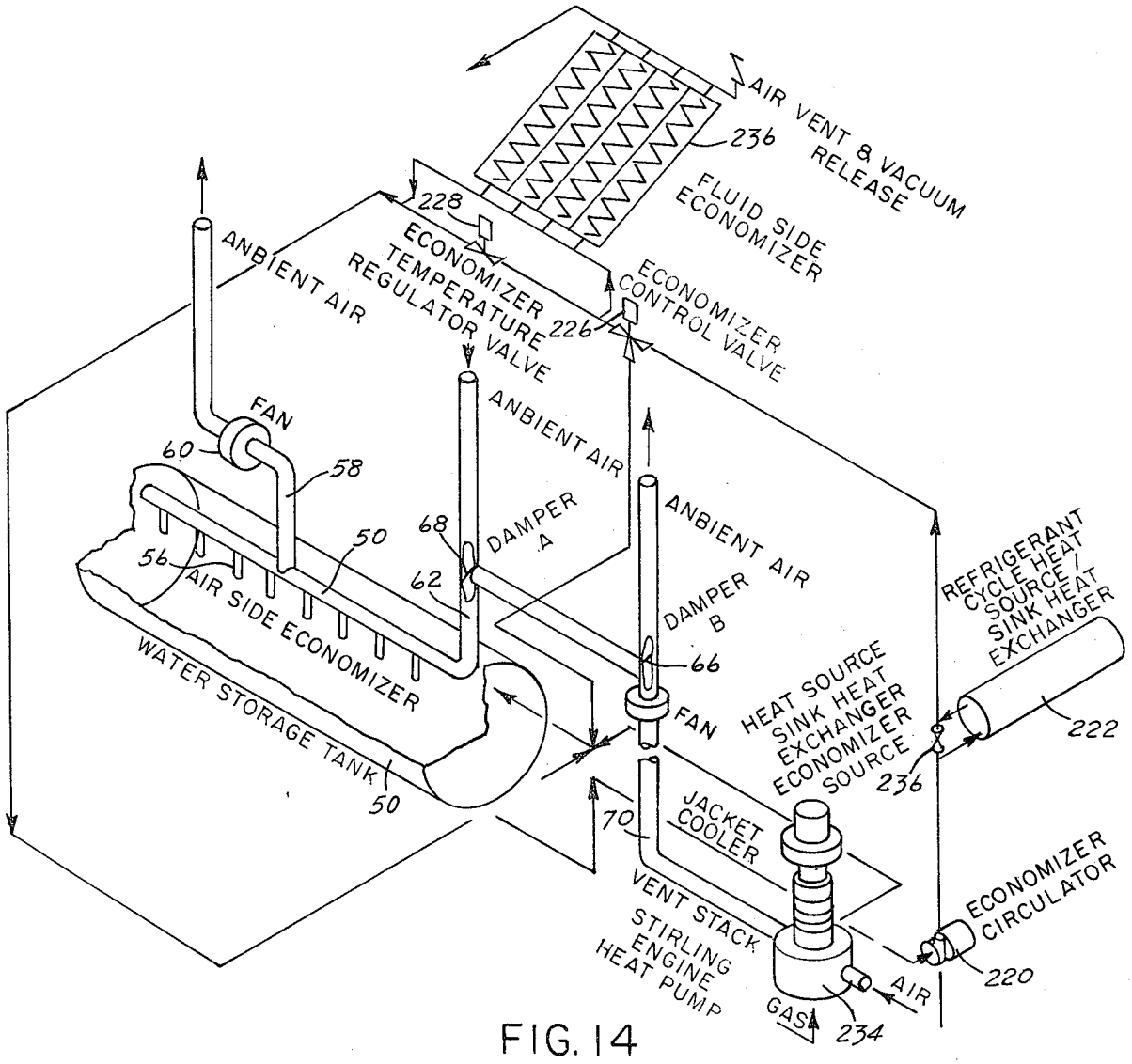
FIG. 14 is a Stirling engine heat pump economizer.

A fuel cell power plant coupled with electric driven economizer refrigerant cycle space heating/cooling and process heating system is also contemplated by the present invention. Fuel cells derive their energy from an electrochemical reaction of hydrogen combining with oxygen to form water. A conventional fuel is converted into hydrogen gas which is then split into hydrogen ions and electrons at an anode (−). The ions move through an electrolyte, while the electrons move through an external circuit, both drawn towards a cathode (+). At the cathode, the hydrogen, electrons, and oxygen (from the air) combine to form water. The flow of electrons through the external from anode to cathode is electricity. FIG. 14 shows a fuel cell power plant cogenerator with the economizer cycle of the present invention.

The economizer for a fuel cell power plant cogenerator is essentially the same in principle as that of FIG. 9 as will be disclosed except that there is included the economizer coolant use for continuous recovery of heat from an on-site fuel cell power plant.

When the fuel cell is generator power, the economizer circulator 220 pumps fluid to and through the fuel cell power plant, removes heat from the heat exchangers, and back to the source 220. The economizer operates normally to manage the thermal requirement of both the fuel cell power plant and the refrigeration cycle. The preferred embodiment of this invention uses water as the coolant.

About 40% of the energy available in the fuel is converted to electric power and about 40% is converted to thermal energy at temperatures below those which can be used for space and process heating. By employing the economizer refrigeration cycle to recover the heat from the fuel cell and to add several times the heat recovered from the fuel cell through the economizer from other sources such as solar, low temperature geo thermal, waste heat and the like. The present invention provides a means of raising the temperatures to usable temperatures that is both energy efficient and cost effective. The cogenerator configuration allows the refrigeration cycle to be employed for cooling a load in the economizer cycle manner with heat being rejected from both the fuel cell and the refrigeration cycle.

While only single unit economizer cycle systems have been discussed, it will be apparent that other configurations may be used such as single economizers with multiple refrigeration cycles; multiple economizers with multiple refrigeration cycles; multiple economizers with single refrigeration cycles; single fuel cells with single economizers and multiple refrigeration cycles; single fuel cells with multiple economizers and multiple refrigeration cycles; multiple fuel cells with multiple economizers and multiple refrigeration cycles; multiple fuel cells with multiple economizers and single refrigeration cycles; multiple fuel cells with single economizers and single refrigeration cycles; multiple fuel cells with single economizers and multiple refrigeration cycles; and, single fuel cells with multiple economizers and single refrigeration cycles.

Figure 13:
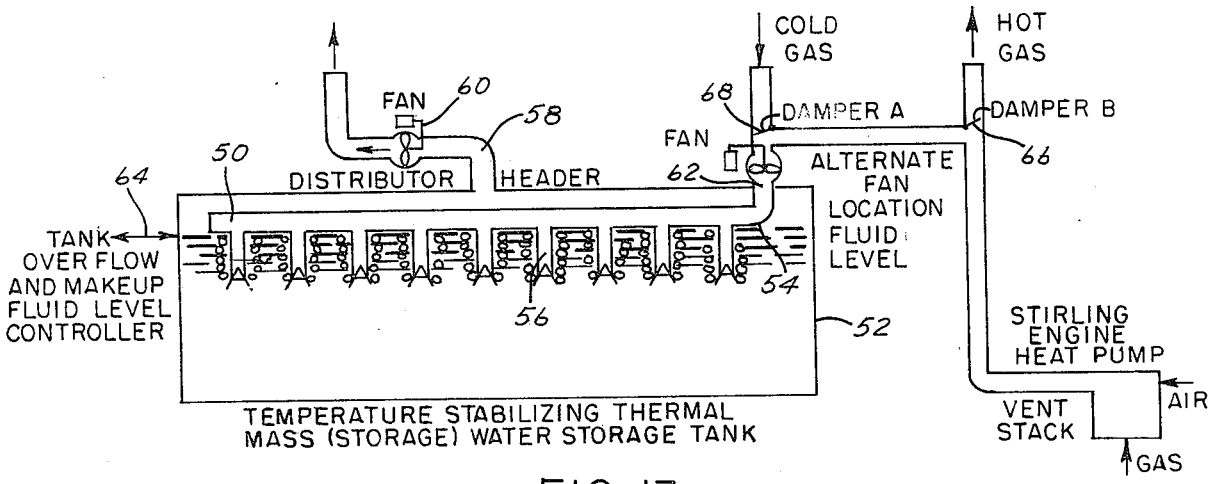
FIG. 13 is an air side economizer.

FIG. 13 shows an air side economizer according to the present invention. FIG. 14 shows the entire economizer and both FIGS. 13 and 14 show the economizer in its preferred configuration with a water tank for thermal storage.

The air side economizer of FIGS. 13 and 14 performs two functions of heating water in a tank with the available sensible and latent heat from a hot gas stream as well as cooling water in a tank by adding available sensible and latent heat to a cool gas system. A gas with moisture in it will place heat in another matter by conduction when the gas is hotter than the matter and comes in contact with it. The available heat in the gas is the amount of heat represented by the weight of the gas times the specific heat of the gas times the drop in temperature of the gas (from the transfer of heat from the gas to the matter) plus the heat of vaporization released from vapor in the gas which is released in condensing the moisture in the gas down to the saturation vapor pressure at the temperature of the matter. The available heat is equal to the weight of the matter times its specific heat times its rise in temperature. Likewise, when a gas comes in contact with a liquid and the vapor pressure in the gas is less than saturated, vaporization will occur and the gas and fluid will be cooled by an amount equal to the heat of vaporization, and the gas being cooler than the liquid and heat will be conducted from the liquid to the gas and its entrained vapor.

The invention consists of a tank of fluid, preferably water; a hot and cold gas source with a damper or plurality of dampers to select either for use in the economizer. The cold gas source may be atmospheric air and the hot gas preferably being a combustion byproduct containing combined hydrogen and oxygen (superheated water vapor); a distribution heater 50 in the water tank disposed above the water level 54 in the tank with gas jet nozzles 56 extending down into the water in the tank with an opening which will allow gas under positive pressure to be discharged therefrom under pressure into the fluid causing the formation of swell bubbles which produces turbulence in the fluid around the nozzles as the bubbles rise to the surface with the distribution header being connected to the hot and cold gas ducts; a relief duct 58 connecting the top of the tank to the atmosphere; a fan 60 or plurality of fans positioned in relief duct 58 and inlet duct 62 to cause the pressure in the distribution header to be sufficiently higher than the pressure above the fluid surface in the tank to produce gas jets from the nozzles 56; and, a tank overflow 64 and make up fluid source disposed to maintain the fluid level in the tank at a desired level.

There are many means for making the nozzle orifices through which the gas passes into the fluid ranging from a cone inserted into the nozzle tube to a nozzle head with tangential orifices that cause a swirling action in the fluid.

When the fluid in tank 52 is too cold and heating is required, the dampers 66 and 68 are positioned to close off the introduction of cold gas to inlet 62 and open the hot gas duct for introduction of hot gases from conduit 70 into inlet 62 to add heat to the liquid in tank 52 by conduction and condensation. Any excess fluid is removed through overflow 64.

When the fluid in tank 52 is too hot and cooling is required, the dampers 66 and 68 are repositioned to open the damper 68 and introduce cold gas to header 50 and close off damper 66 to stop introduction of hot gases. Make up fluid is introduced when necessary by the liquid level control in overflow 64.

It will be obvious that the distribution header could be positioned below the liquid level 54 in tank 50 or the gas jet nozzles 56 positioned further into the fluid body. It is desirable to keep the heat of fluid against which the fans operate at a minimum while allowing the desired heat transfer to occur.

FIG. 15 is a block diagram of the prior art introduction of waste engine heat directly to the load while FIG. 16 is a block diagram according to the present invention for utilizing the waste heat from the heat engine of a heat engine driven heat pump in the most energy and cost efficient manner. According to the present invention, FIG. 16, the waste heat from the heat engine is introduced into the fluid entering a fluid to the refrigerant counterflow indirect heat exchanger evaporator. FIG. 17 illustrates a typical compressor performance of the prior art versus the present invention at 115° F. condensing temperature.

While there have been described what at present are considered to be the preferred embodiments of this invention, it will be obvious to those skilled in the art that various changes and modifications may be made therein without departing from the invention. It is aimed, therefore, in the appended claims to cover all such changes and modifications which fall within the true spirit and scope of the invention.

What is claimed is:

1. An economizer refrigeration cycle space heating-/cooling system and process heating system which comprises:

a compressor means, a load side heat exchanger and a heat source/sink heat exchanger connected thereto, an economizer circulator, an economizer control valve, an excess heat rejection economizer and a temperature stabilizing thermal mass storage filled with a coolant all connected in series with the heat source/sink heat exchanger which is disposed above the thermal mass storage to permit the coolant to be diverted by the economizer valve to flow from the heat source/sink heat exchanger through the excess heat rejection heat exchanger to the temperature stabilizing thermal mass storage and back to the suction side of the economizer circulator or selectively with the coolant bypassing the heat source/sink heat exchanger to the temperature stabilizing thermal mass storage, said temperature stabilizing thermal mass storage having a thermal capacitance greater than the sensible heat of the contained coolant at operating temperatures below ambient atmosphere temperature with the economizer circulator being operated to maintain the refrigeration cycle condensing temperature above the evaporating temperature, said heat source/sink heat exchanger economizer valve being adapted to maintain a substantially constant condensing temperature as the evaporating temperature or load changes and adapted to bypass the heat source/sink heat exchanger to permit reduction of the amount of heat in the thermal mass storage during times of refrigeration cycle in operation; and, an economizer temperature regulator valve adapted to control the amount of heat rejected from the excess heat rejection economizer by regulating the amount of coolant directed to the economizer.

2. The system of claim 1 including an excess heat rejection economizer in series with the economizer circulator and the thermal mass storage and an economizer control valve adapted to selectively direct the coolant from the economizer circulator directly to the storage mass or through the excess heat rejection economizer.

3. The system of claim 2 wherein the compressor is a Stirling cycle engine and the excess heat rejection economizer includes an air side economizer comprising a tank of water, gas nozzles for injecting hot and cold gases in heat exchange relation to the water body.

4. The system of claim 2 wherein the compressor is an internal combustion engine and the excess heat rejection economizer includes an air side economizer comprising a tank of water, gas nozzles for injecting hot and cold gases in heat exchange relation to the water body.

* * * * *